US010834961B2

(12) United States Patent
Kuersteiner et al.

(10) Patent No.: US 10,834,961 B2
(45) Date of Patent: Nov. 17, 2020

(54) RADIALLY FIRM SMOKING ARTICLE FILTER

(71) Applicant: PHILIP MORRIS PRODUCTS S.A., Neuchatel (CH)

(72) Inventors: Charles Kuersteiner, Jouxtens-Mezery (CH); Alen Kadiric, Orpund (CH); Martha Martha, Surabaya (ID); Nicolas Cusnir, Lausanne (CH)

(73) Assignee: Philip Morris Products S.A., Neuchatel (CH)

( * ) Notice: Subject to any disclaimer, the term of this patent is extended or adjusted under 35 U.S.C. 154(b) by 22 days.

(21) Appl. No.: 14/896,451

(22) PCT Filed: Feb. 13, 2014

(86) PCT No.: PCT/EP2014/052856
§ 371 (c)(1),
(2) Date: Dec. 7, 2015

(87) PCT Pub. No.: WO2015/007400
PCT Pub. Date: Jan. 22, 2015

(65) Prior Publication Data

US 2016/0128378 A1 May 12, 2016

(30) Foreign Application Priority Data

Jul. 16, 2013 (EP) ..... 13176749

(51) Int. Cl.
*A24D 3/04* (2006.01)
*A24D 1/02* (2006.01)

(52) U.S. Cl.
CPC ..... *A24D 3/04* (2013.01); *A24D 1/02* (2013.01)

(58) Field of Classification Search
CPC ..... A24D 3/04; A24D 1/02
(Continued)

(56) References Cited

U.S. PATENT DOCUMENTS 3,861,404 A * 1/1975 Changani ..... A24D 3/08 131/332
4,481,960 A * 11/1984 Brooks ..... A24D 1/02 131/336

(Continued)

FOREIGN PATENT DOCUMENTS

CN 87102577 10/1988
CN 101896082 11/2010

(Continued)

OTHER PUBLICATIONS

Xebex (Xebex International, Ltd., Taber Type Stiffness Tester, www.xebex.jp/Prod/cn17/155-158.html, published 2009).*

(Continued)

*Primary Examiner* — Eric Yaary
*Assistant Examiner* — Russell E Sparks
(74) *Attorney, Agent, or Firm* — Mueting Raasch Group

(57) ABSTRACT

There is provided a smoking article comprising a tobacco rod, a filter and tipping material attaching the tobacco rod and the filter. The filter comprises a plug of filtration material that defines a downstream end segment of the smoking article, the plug being surrounded by one or more filter wrappers. The hardness of the smoking article at the downstream end segment is at least about 90%, and the filtration material extends to the furthest downstream end of the filter.

9 Claims, 8 Drawing Sheets

(58) Field of Classification Search
USPC ..... 131/331
See application file for complete search history.

(56) References Cited

U.S. PATENT DOCUMENTS

| | | | | |
|---|---|---|---|---|
| 4,920,990 | A | 5/1990 | Lawrence | |
| 4,998,543 | A * | 3/1991 | Goodman | A24D 1/02 131/365 |
| 5,568,819 | A * | 10/1996 | Gentry | A24D 3/04 131/331 |
| 5,823,201 | A | 10/1998 | Matsumura | |
| 6,595,217 | B1 | 7/2003 | Case | |
| 6,776,168 | B1 | 8/2004 | Teufel | |
| 7,699,061 | B2 | 4/2010 | Sietert | |
| 7,717,120 | B2 * | 5/2010 | Snaidr | A24D 1/02 131/365 |
| 7,942,154 | B2 | 5/2011 | Taniguchi | |
| 7,980,250 | B2 | 7/2011 | Clarke | |
| 8,602,036 | B2 | 12/2013 | Marquez | |
| 8,746,255 | B2 | 6/2014 | Hasegawa | |
| 8,790,556 | B2 * | 7/2014 | Bundren | B29C 47/12 264/103 |
| 2008/0017206 | A1 * | 1/2008 | Becker | A24B 15/282 131/276 |
| 2010/0242977 | A1 | 9/2010 | Tarora | |
| 2010/0288293 | A1 | 11/2010 | Slasli | |
| 2011/0180088 | A1 * | 7/2011 | Hooper | A24C 5/56 131/365 |
| 2012/0118309 | A1 * | 5/2012 | Taniguchi | A24D 3/10 131/342 |
| 2014/0366901 | A1 * | 12/2014 | Shinozaki | A24F 13/02 131/337 |

FOREIGN PATENT DOCUMENTS

| | | | | |
|---|---|---|---|---|
| DE | 4206508 | A1 * | 9/1993 | A24C 5/40 |
| EA | 014268 | | 10/2010 | |
| EP | 0088178 | | 9/1983 | |
| EP | 0758532 | | 10/2002 | |
| EP | 2229827 | | 9/2010 | |
| EP | 2229827 | A1 † | 9/2010 | |
| EP | 2789249 | | 10/2014 | |
| GB | 2170391 | | 8/1986 | |
| GB | 2170391 | | 7/1988 | |
| GB | 2201879 | | 9/1988 | |
| GB | 2201879 | A * | 9/1988 | A24D 3/0295 |
| JP | S61-247368 | | 11/1986 | |
| JP | H02-190173 | | 7/1990 | |
| JP | 3235953 | | 12/2001 | |
| JP | 2002191345 | | 7/2002 | |
| JP | 3726061 | | 12/2005 | |
| JP | 4546248 | | 9/2010 | |
| JP | 4959342 | | 6/2012 | |
| JP | 5091297 | | 12/2012 | |
| KR | 20130035670 | | 4/2013 | |
| KR | 20130035670 | A † | 4/2013 | |
| RU | 2011151720 | | 8/2014 | |
| WO | WO 2009/077244 | | 6/2009 | |
| WO | WO 2009/078287 | | 6/2009 | |
| WO | WO 2009-078287 | | 6/2009 | |
| WO | WO 2010/079793 | | 6/2012 | |
| WO | WO-2013034652 | A1 * | 3/2013 | A24D 3/045 |
| WO | WO 2013/084661 | | 6/2013 | |

OTHER PUBLICATIONS

Tappi T 489 (Bending resistance (stiffness) of paper and paperboard (Taber-type tester in basic configuration) (Revision of T 489 om-08), www.tappi.org/content/tag/sarg/t489.pdf, published Apr. 30, 2013).*
Xebex Catalogue (No. 155 Taber type Stiffness Tester, www.xebex.jp_userdata/Toyo-155.pdf).*
Coresta Recommended Method No. 41, Determination of the Draw Resistance of Cigarettes and Filter Rods, https://www.coresta.org/sites/default/files/technical_documents/main/CRM_41-update2_0.pdf, Published Jun. 2007.*
Trademark Electronic Search System, p. 1, Good and Services, http://tess2.uspto.gov/bin/showfield?f=doc&state=4809: vyzx73.5.1.*
Machine translation of DE 4206508 (Year: 1993).*
"Paper and Board—Determination of Bending Stiffness—General Principles for Two-Point, Three-Point and Four-Point Methods", International Standard SO 5628 dated Jan. 15, 2012 (16 pages).
Brown & Williamson Tobacco Corporation, Research & Development, File Note dated Jan. 28, 1993.
B.A.T. (UK and Export) Limited, Research & Development, dated Jan. 21, 1987.
European Extended Search Report for Application No. 13176749.3 dated Jan. 23, 2014 (6 pages).
PCT Search Report and Written Opinion for PCT/EP2014/052856 dated Sep. 19, 2014 (6 pages).
Fiscal Report of Schweitzer-Mauduit International 10-K 2006 for the fiscal year ending Dec. 31, 2005 (6 pages).
Office Action issued in Japan for Application No. 2016-526471 dated Nov. 27, 2017 (6 pages). English translation included.
Office Action issued in Russia for Application No. 2016204568 dated Feb. 7, 2018 (7 pages). English translation included.
Office Action issued in China for Application No. 201480037284.X dated Sep. 5, 2018 (18 pages). English translation included.
Escusta Standard Products Catalog Plug Wrap, Effective Sep. 15, 1986, 8 pages.

* cited by examiner
† cited by third party

RADIALLY FIRM SMOKING ARTICLE FILTER

This application is a U.S. National Stage Application of International Application No. PCT/EP2014/052856, filed Feb. 13, 2014, which was published in English on Jan. 22, 2015 as International Patent Publication WO 2015/007400 A1. International Application No. PCT/EP2014/052856 claims priority to European Application No. 13176749.3 filed Jul. 16, 2013.

The present invention relates to a filter for a smoking article, and a smoking article comprising a filter.

Combustible smoking articles, such as cigarettes, generally comprise shredded tobacco (usually in cut filler form) surrounded by a paper wrapper forming a tobacco rod. A cigarette is employed by a consumer by lighting one end thereof and burning the shredded tobacco rod. The consumer then receives mainstream smoke by drawing on the opposite end (mouth end or filter end) of the cigarette. The shredded tobacco can be a single type of tobacco or a blend of two or more types of tobacco.

Smoking articles, particularly cigarettes, generally comprise a filter aligned in end-to-end relationship with the tobacco rod or other aerosol forming substrate. Typically, the filter includes a plug of cellulose acetate tow attached to the tobacco rod or substrate by tipping paper which overlies the filter and an adjacent portion of the tobacco rod. Ventilation of mainstream smoke can be achieved with a row or rows of perforations in the tipping paper about a location along the filter.

Some consumers in certain markets such as Korea, enjoy chewing the mouth end of the filter while smoking the smoking article. Consumers generally want the filter to provide some resistance during the chewing action. However, the chewing action may deform the filter shape, which, in turn, may affect the smoking experience. Consumers may also perceive filters which are not particularly firm to be of lower quality.

It would therefore be desirable to provide a filter for a smoking article which provides for an improved sensory experience for consumers, such as an improved chewing experience.

According to a first aspect of the invention, there is provided a smoking article comprising: a tobacco rod; a filter comprising a plug of filtration material that defines a downstream end segment of the smoking article, the plug being surrounded by one or more filter wrappers; and tipping material attaching the tobacco rod and the filter; wherein the hardness of the smoking article at the downstream end segment is at least about 90%, wherein the filtration material extends to the furthest downstream end of the filter, and wherein the one or more filter wrappers have a basis weight between about 50 grams per square meter and about 100 grams per square meter.

The inventors of the present invention have found that, in order for a consumer to be able to enjoy chewing the mouth end of the smoking article filter during the smoking experience, the mouth end must have a hardness of at least about 90%. This provides sufficient resistance for the consumer, in order to make the chewing experience more enjoyable. If the hardness is lower than about 90%, the mouth end may be considered too yielding and soft for the consumer. In addition, the filtration material of the filter plug extends to the furthest downstream end, a mouth end, of the smoking article. That is, the mouth end of the filter is filled and does not form a cavity or hollow mouth end. This may provide additional resistance for a consumer which may further improve the chewing experience. In contrast to hollow mouth ends, the mouth end of the filter will not collapse when chewed.

By providing a filter having a hardness of at least 90% at the mouth end and providing filtration material extending to the mouth end, the overall sensory experience for a consumer may be improved. This is because the filter mouth end provides enough resistance to deformation for the chewing to be enjoyable for a consumer, and may be perceived to have a higher overall quality.

In this specification, the terms "upstream" and "downstream" are used to describe relative positions between elements of the filter or smoking article in relation to the direction of mainstream smoke as it is drawn from a lit end of the smoking article through the filter. Mainstream smoke flows generally parallel to the length of the smoking article, in the longitudinal direction. The transverse direction of the smoking article is perpendicular to the longitudinal direction.

The term "hardness" used throughout this specification denotes the resistance to deform. Hardness is generally expressed as a percentage. FIG. 1 shows a cigarette 101 before applying a load F and the same cigarette 103 whilst applying load F. The cigarette 101 before load F has been applied has a diameter $D_s$. The cigarette 103 after applying a set load for a set duration (but with the load still applied) has a (reduced) diameter $D_d$. The depression is $d=D_s-D_d$. Referring to FIG. 1, hardness is given by:

$$\text{hardness}(\%) = \frac{D_d}{D_s} * 100\%$$

where $D_s$ is the original (undepressed) cigarette diameter, and $D_d$ is the depressed diameter after applying a set load for a set duration. The harder the material, the closer the hardness is to 100%.

As is described in more detail below, and generally known in the art, to determine the hardness of a portion (such as a filter) of a smoking article, smoking articles should be aligned parallel in a plane and the same portion of each smoking article to be tested should be subjected to a set load for a set duration. This test is performed using a known DD60A Densimeter device (manufactured and made commercially available by HEINR. BORGWALDT GmbH, Germany), which is fitted with a measuring head for cigarettes and with a cigarette receptacle.

The load is applied using two load applying cylindrical rods, which extend across the diameter of all of the smoking articles at once. According to the standard test method for this instrument, the test should be performed such that twenty contact points occur between the smoking articles and the load applying cylindrical rods. In some cases, the filters to be tested may be long enough such that only ten smoking articles are needed to form twenty contact points, with each smoking article contacting both load applying rods (because they are long enough to extend between the rods). In other cases, if the filters are too short to achieve this, then twenty smoking articles should be used to form the twenty contact points, with each smoking article contacting only one of the load applying rods, as further discussed below.

Two further stationary cylindrical rods are located underneath the smoking articles, to support the smoking articles and counteract the load applied by each of the load applying cylindrical rods. Such an arrangement is described in more detail below, and shown in FIGS. 4 to 6.

For the standard operating procedure for such an apparatus, an overall load of 2 kg is applied for a duration of 20 seconds. After 20 seconds have elapsed (and with the load still being applied to the smoking articles), the depression in the load applying cylindrical rods is determined, and then used to calculate the hardness from the above equation. The temperature is kept in the region of 22 degrees Centigrade±2 degrees. The test described above is referred to as the DD60A Test. The DD60A Test and corresponding apparatus are described in more detail below in relation to FIGS. 4 to 6. As discussed in more detail below, the hardness of a filter portion of a smoking article does not greatly differ when the smoking article is smoked rather than unsmoked. However, the standard way to measure the filter hardness is when the smoking article is unsmoked.

According to the invention, the hardness of the smoking article at the downstream end (mouth end) segment is at least about 90%. More preferably, the hardness of the smoking article at the downstream end segment is at least about 92%. This provides even better resistance for the consumer, for example when chewing.

It may be advantageous for the hardness of the smoking article according to the invention to be primarily provided by the one or more filter wrappers, rather than by the tipping material. This will prevent the need for particularly thick tipping material. This may allow the ventilation zone to be formed in the tipping material straightforwardly. This may also allow the tipping material to be easily curved around the smoking article during manufacture, to attach the tobacco rod and filter.

Accordingly, the one or more filter wrappers have a basis weight greater than about 50 grams per square meter ($gm^{-2}$). It has been found that this provides the desired hardness, whilst still limiting the ovality reached after deformation. The one or more filter wrappers have a basis weight less than about 100 $gm^{-2}$. It has been noted that such a value can provide a good balance between hardness and ovality, whilst still allowing the filter wrapper to be relatively straightforward to handle during manufacture.

Preferably, the one or more filter wrappers have a basis weight between about 65 $gm^{-2}$ and about 85 $gm^{-2}$. Even more preferably, the one or more filter wrappers have a basis weight between about 70 $gm^{-2}$ and about 80 $gm^{-2}$. In preferred embodiments, a single filter wrapper is provided and this single filter wrapper has a basis weight as set out above. Alternatively, in some embodiments, multiple filter wrappers may be provided, and the combined basis weight of the multiple wrappers may be the basis weight as set out above.

In order for a consumer to be able to enjoy chewing the mouth end of the smoking article filter, it is preferable for there to be some (limited) yield when the consumer chews. Thus, preferably the hardness of the smoking article at the downstream end segment is no more than about 94%.

The inventors of the present invention have also found that, in order for a consumer to be able to continue to enjoy the smoking experience after chewing the mouth end, it is preferable that the mouth end return to as close to circular as possible after chewing. That is to say, preferably, the mouth end has a low ovality after deformation (for example, after chewing).

The term "ovality" used throughout this specification denotes the degree of deviation from a perfect circle. Ovality is generally expressed as a percentage. FIG. 2 shows a perfect circle. In FIG. 2, dimension a=dimension b, since both dimensions are equal to the diameter of the circle. FIG. 3 shows an oval. In FIG. 3, dimension a≠dimension b. Referring to FIGS. 2 and 3, ovality is given by:

$$\text{ovality}(\%) = \frac{2(a-b)}{a+b} * 100\%$$

where a is the largest external diameter of the oval or circle and b is the smallest external diameter of the oval or circle. In the case of an oval or ellipse, a is the major axis of the ellipse, and b is the minor axis of the ellipse. Since a=b in a perfect circle, the ovality of a perfect circle is equal to 0%.

To determine the ovality of a portion (such as a filter) of a smoking article in accordance with the present invention, the mouth end is viewed along the longitudinal direction of the smoking article. For example, the smoking article may be positioned on the mouth end on a transparent stage, so that an image of the mouth end of the smoking article is recorded by a suitable imaging device located below the stage. The process is repeated for a total of ten smoking articles having the same design and the average of the ten ovality measurements is recorded as the ovality for that particular design of smoking article.

To simulate the smoking of a smoking article, the smoking article is subjected to a standard smoking test under ISO conditions (35 ml puffs lasting 2 seconds each, with puffs occurring once every 60 seconds) as set out in ISO 4387: 2000. In the ISO test method, the smoking article is smoked with the ventilation zone fully uncovered. Where it is necessary to measure the ovality after deformation tests performed both before and after smoking, two samples of smoking articles having the same design should be used. That is, non-deformed unsmoked smoking articles should be used for the pre-smoking deformation tests, and non-deformed smoking articles having the same design are subjected to the smoking test and used for the post-smoking deformation tests.

It is preferable that the mouth end has a low ovality after deformation. It has been found that smoking article filters having softer filter wrappers may also tend to have a low ovality after deformation. However, such filter wrappers may be too soft for the chewing experience to be enjoyable for the consumer. Thus, preferably, the ovality of the furthest downstream end of the smoking article, after a 50% deformation of the furthest downstream end of the smoking article, is less than about 25%. This means that, in conjunction with a minimum hardness of at least about 90%, after a 50% deformation, the mouth end of the smoking article has a maximum ovality of about 25%. This enables the smoking experience to be enjoyed after chewing, and also provides a sufficiently hard mouth end for the chewing experience itself to be enjoyable.

Moreover, it is preferable that the mouth end return to as close to circular as possible after chewing, even after smoking. Thus, preferably, the ovality of the furthest downstream end of the smoking article, after a 50% deformation of the furthest downstream end of the smoking article, performed after the smoking article has been subjected to a smoking test (as described above), is less than about 25%.

Preferably, the tipping material includes a ventilation zone at a location about the filter. The ventilation zone may comprise perforations through the tipping material. The amount of ventilation, including the number, layout, position and size of perforations, may be selected to provide the desired level of ventilation, before and after chewing.

Preferably the perforations extend through the filter wrapper or wrappers surrounding the plug of filtration material. Alternatively, the filter wrapper or wrappers may be porous. The tipping material may be standard pre-perforated tipping material. Alternatively, the tipping material may be perforated (for example, using a laser) during the manufacturing process according to the desired number, size and position of the perforations.

The one or more filter wrappers may comprise any suitable material or combination of materials. Examples of suitable materials include, but are not limited to, cellulose based materials, paper, cardboard, recon, cellulose based film, and combinations thereof. The one or more filter wrappers may be printed, embossed, debossed or otherwise embellished with manufacturer or brand logos, trade marks, slogans and other consumer information and indicia. Preferably, however, the one or more filter wrappers comprise paper.

Preferably, the one or more filter wrappers have low porosity. Preferably, the one or more filter wrappers have a porosity of less than about 1000 Coresta units, more preferably less than about 500 Coresta units, and even more preferably less than about 100 Corresta units. The porosity may be as low as 100 Coresta units or lower, or 20 Coresta units or lower. In addition, or in the alternative, the porosity may be more than about 1 Coresta unit. Such low porosity filter wrappers may help to improve the strength of the filter, and may help to increase the critical load of the smoking article. This can be particularly beneficial when the filter includes perforations extending through the tipping paper and the one or more filter wrappers.

As already discussed, it may be advantageous for the hardness of the smoking article according to the invention to be primarily provided by the one or more filter wrappers, rather than by the tipping material. Accordingly, preferably, the one or more filter wrappers have a bending stiffness of at least about 0.08 N in the machine direction of the filter wrapper. The one or more filter wrappers may have a bending stiffness less than about 0.2 N in the machine direction of the filter wrapper. The machine direction of the filter wrapper preferably corresponds to the transverse direction of the smoking article.

Preferably, the one or more filter wrappers have a bending stiffness of at least about 0.04 N in the cross direction of the filter wrapper. The one or more filter wrappers may have a bending stiffness less than about 0.1 N in the cross direction of the filter wrapper. The cross direction of the filter wrapper preferably corresponds to the longitudinal direction of the smoking article.

The term "bending stiffness" used in this specification refers to the resistance of the material to a bending force applied perpendicular to the plain of the material. The bending stiffness may be determined by International Organization for Standardization (ISO) test ISO 5628: 2012.

If more than one filter wrapper is provided, the total bending stiffness in a given direction of the one or more filter wrappers is the combined bending stiffness of each of the filter wrappers.

The diameter of the smoking article (which is the total diameter of the plug of filtration material together with the tipping material and the filter wrapper or wrappers, measured in a direction substantially perpendicular to the longitudinal axis of the smoking article) may have any suitable value. However, it may be convenient for the diameter to be substantially the same as in conventional smoking articles.

Any suitable smoking article diameter may be selected. However, preferably the diameter is between about 7.0 mm and about 8.0 mm, more preferably about 7.8 mm, even more preferably about 7.84 mm. The diameter may be about 7.0 mm.

The length of the filter (which is the total length of the filter, including the plug of filtration material, measured in a direction substantially parallel to the longitudinal axis of the smoking article) may have any suitable value. However, it may be convenient for the filter length to be substantially the same as in conventional smoking articles. The length designates the total length of the filter, including the plug of filtration material. That is, if the filter comprises one or more filter segments in addition to the plug of filtration material, the length is the total length of all the filter segments and the plug of filtration material. If the filter comprises only the plug of filtration material, the length is the length of only the plug of filtration material.

Preferably, the filter has a length between about 15 mm and about 40 mm. Even more preferably, the filter has a length between about 18 mm and about 27 mm. In one embodiment, the filter has a length of about 27 mm. In another embodiment, the filter has a length of about 21 mm.

The filtration material may comprise any suitable material or combination of materials. The type of filtration material may be selected to provide the desired level of RTD during smoking and the desired level of hardness and ovality after deformation. Examples of suitable materials include, but are not limited to, cellulose acetate, cellulose, reconstituted cellulose, polylactic acid, polyvinyl alcohol, nylon, polyhydroxybutyrate, thermoplastic material, such as starch, non-woven materials, longitudinally oriented fibres and randomly oriented fibres, paper, crepe, PLA fibres, and combinations thereof. One or more of the materials may be formed into an open cell structure. All or part of the filter may include activated carbon or other sorbent material. The filter may include an adhesive or plasticiser or a combination thereof. The filtration material may be compressible. In preferred embodiments, the filtration material comprises cellulose acetate.

The filtration material may have any suitable denier per filament (dpf) and total denier (td). Preferably, however, the filtration material has a denier per filament (dpf) of between about 5.0 dpf and about 12.0 dpf more preferably between about 6.0 dpf and about 10.0 dpf. Preferably, the filter segment has a total denier of less than about 30,000, more preferably less than about 25,000. Additionally, or alternatively, the filter segment has a total denier of greater than about 10,000. In a preferred embodiment, the filter segment comprises large diameter fibres of about 15000 total denier. The number of fibres present in the filter segment (the total denier divided by the dpf) may be less than about 6,000, preferably less than about 5,000. In one preferred embodiment, the filter material of the filter segment comprises fibres of between about 5.0 and about 12.0 denier per filament and between about 12000 and about 30000 total denier.

Preferably, the filter includes a flavourant. The flavourant should be suitable for interacting with and modifying the characteristics of the smoking article and thus the smoke derived therefrom. For example, the flavourant may impart a flavour to enhance the taste of the mainstream smoke produced during smoking.

The flavourant may be provided directly onto a component of a filter. Alternatively, the flavourant may be provided as part of a flavourant delivery member that is configured to release the flavourant in response to a trigger mechanism. Such a trigger mechanism may include the application of a force to the filter, a change in temperature in the filter, a chemical reaction, or any combination thereof.

Where the flavourant is provided as part of a flavourant delivery member, the flavourant delivery member may have any suitable structure in which a structural material releasably encloses a flavourant or flavourants. For example, in some preferred embodiments, the flavourant delivery member comprises a matrix structure defining a plurality of domains, the flavourant being trapped within the domains until released, for example, when the smoking article is subject to external force. Alternatively, the flavourant delivery member may comprise a capsule. Preferably, the capsule comprises an outer shell and an inner core containing the flavourant. Preferably, the outer shell is sealed before the application of an external force, but is frangible or breakable to allow the flavourant to be released when the external force is applied. The capsule may be formed in a variety of physical formations including, but not limited to, a single-part capsule, a multi-part capsule, a single-walled capsule, a multi-walled capsule, a large capsule, and a small capsule.

If the flavourant delivery member comprises a matrix structure defining a plurality of domains enclosing the flavourant, the flavourant delivery member may release the flavourant steadily when the smoking article is subject to external force. Alternatively, if the flavourant delivery member is a capsule arranged to rupture or burst to release the flavourant when the smoking article is subject to external force (for example, but not limited to, if the capsule comprises an outer shell and an inner core), the capsule may have any desired burst strength. The burst strength is the force (exerted on the capsule from the outside of the smoking article) at which the capsule will burst. The burst strength may be a peak in the capsule's force versus compression curve.

Suitable flavourants include, but are not limited to, materials that contain natural or synthetic menthol, peppermint, spearmint, coffee, tea, spices (such as cinnamon, clove and ginger), cocoa, vanilla, fruit flavours, chocolate, eucalyptus, geranium, eugenol, agave, juniper, anethole and linalool.

The tipping material may comprise any suitable material or combination of materials. Examples of suitable materials include, but are not limited to, cellulose based materials, paper, cardboard, recon, cellulose based film, and combinations thereof. The tipping material may be printed, embossed, debossed or otherwise embellished with manufacturer or brand logos, trade marks, slogans and other consumer information and indicia. Preferably, however, the tipping material comprises paper. The thickness of the tipping material is preferably between about 30 μm and about 70 μm, more preferably about 40 μm.

Preferably, the filter comprises filtration material extending along the whole length of the filter. Preferably, this is in the form of a single segment filter. That is to say, preferably, the only filter segment in the filter is the plug of filtration material. Preferably, no additional filter segments are provided either upstream or downstream of the plug of filtration material.

Alternatively, as long as the filtration material of the filter plug, extends to the mouth end of the smoking article, the filter may include one or more additional filter elements upstream of the plug of filtration material. Thus, exemplary filter structures that may be used include, but are not limited to, a mono filter, a dual filter, a triple filter, a single or multi cavity filter, and combinations thereof.

If the filter comprises a multi component filter comprising a plurality of filter segments, the one or more filter wrappers may surround one, some or all of the filter segments. Preferably, each filter segment comprises a respective filter wrapper and the whole filter is surrounded by a further filter wrapper.

If the filter comprises a multi component filter comprising a plurality of filter segments, the tipping material may surround all the filter segments plus the adjacent portion of the tobacco rod. Alternatively, the tipping material may surround only a portion of the filter, plus the adjacent portion of the tobacco rod.

The filter may provide any suitable resistance to draw (RTD). Preferably, the filter provides an RTD of between about 130 mm $H_2O$ and about 210 mm $H_2O$.

The tobacco rod may comprise any suitable type or types of tobacco material or tobacco substitute, in any suitable form.

Preferably, the tobacco rod includes flue-cured tobacco, Burley tobacco, Maryland tobacco, Oriental tobacco, rare tobacco, specialty tobacco, or any combination thereof. Preferably, the tobacco is provided in the form of tobacco lamina, processed tobacco materials, such as volume expanded or puffed tobacco, processed tobacco stems, such as cut-rolled or cut-puffed stems, reconstituted tobacco materials, blends thereof, and the like.

In some preferred embodiments, the tobacco is in the form of cut filler, that is, in the form of shreds or strands cut into widths ranging from about 2.5 mm to about 1.2 mm or even about 0.6 mm. Preferably, the lengths of the strands range from between about 6 mm to about 75 mm.

Preferably, the tobacco rod has a tobacco packing density of at least about 200 $mg/cm^{-3}$. More preferably, the tobacco rod has a tobacco packing density of at least about 220 $mgcm^{-3}$. More preferably, the tobacco rod has a tobacco packing density of at least about 240 $mg/cm^{-3}$.

According to a second aspect of the invention, there is provided a filter for a smoking article, the filter comprising: a plug of filtration material that defines a downstream end segment of the filter; one or more filter wrappers surrounding the plug of filtration material; wherein the hardness of the filter at the downstream end segment is at least about 90%, and wherein the filtration material extends to the furthest downstream end of the filter, and wherein the one or more filter wrappers have a basis weight between about 50 grams per square meter and about 100 grams per square meter.

By providing a filter having a hardness of at least 90% at the mouth end and providing filtration material extending to the mouth end, the sensory experience for a consumer may be improved. For example, this is because the filter mouth end provides enough resistance to deformation for the likes of chewing to be enjoyable for a consumer.

Preferably, the hardness of the filter at the downstream end segment is at least about 92%. Preferably, the hardness of the filter at the downstream end segment is no more than about 94%.

The inventors of the present invention have also found that, in order for a consumer to be able to continue to enjoy the smoking experience after chewing the mouth end, it is preferable that the mouth end return to as close to circular as possible after chewing. That is to say, preferably, the mouth end has a low ovality after chewing (that is, after deformation). Therefore, preferably, the ovality of the furthest downstream end of the filter, after a 50% deformation of the furthest downstream end of the filter, is less than about 25%.

As discussed in relation to the first aspect of the invention, the one or more filter wrappers may comprise any suitable material or combination of materials.

Preferably, the one or more filter wrappers have a basis weight greater than about 50 grams per square meter ($gm^{-2}$). Preferably, the one or more filter wrappers have a basis weight less than about 100 $gm^{-2}$. More preferably, the one or more filter wrappers have a basis weight between about 65 $gm^{-2}$ and about 85 $gm^{-2}$. Even more preferably, the one or more filter wrappers have a basis weight between about 70 $gm^{-2}$ and about 80 $gm^{-2}$. In preferred embodiments, a single filter wrapper is provided and this single filter wrapper has a basis weight as set out above. Alternatively, in some embodiments, multiple filter wrappers may be provided, and the combined basis weight of the multiple wrappers may be the basis weight as set out above.

In a preferred embodiment, the one or more filter wrappers have a bending stiffness of at least about 0.08 N in the machine direction of the filter wrapper. The one or more filter wrappers may have a bending stiffness less than about 0.2 N in the machine direction of the filter wrapper. The machine direction of the filter wrapper preferably corresponds to the transverse direction of the smoking article.

In a preferred embodiment, the one or more filter wrappers have a bending stiffness of at least about 0.04 N in the cross direction of the filter wrapper. The one or more filter wrappers may have a bending stiffness less than about 0.1 N in the cross direction of the filter wrapper. The cross direction of the filter wrapper preferably corresponds to the longitudinal direction of the smoking article.

As already discussed in relation to the first aspect of the invention, the total bending stiffness in a given direction of the one or more filter wrappers is the combined bending stiffness of each of the filter wrappers.

The diameter of the filter (which is the diameter of the plug of filtration material together with the filter wrapper or wrappers, measured in a direction substantially perpendicular to the longitudinal axis of the filter) may have any suitable value. However, it may be convenient for the filter diameter to be substantially the same as in conventional smoking articles.

As discussed in relation to the first aspect of the invention, the filtration material may comprise any suitable material or combination of materials. The filtration material may have any suitable denier per filament (dpf) and total denier (td), such as any of the ranges mentioned above.

Preferably, the filter comprises filtration material extending along the whole length of the filter. Preferably, this is in the form of a single segment filter. That is to say, preferably, the only filter segment in the filter is the plug of filtration material. Preferably, no additional filter segments are provided either upstream or downstream of the plug of filtration material.

Alternatively, as long as the filtration material of the filter plug, extends to the mouth end of the filter, the filter may include one or more additional filter elements upstream of the plug of filtration material.

Filters according to the present invention may advantageously be used in filter cigarettes and other smoking articles in which tobacco material is combusted to form smoke.

According to a third aspect, the invention is directed to use of a filter, or a method of using a filter, in a smoking article, the filter comprising: a plug of filtration material that defines a downstream end segment of the smoking article; one or more filter wrappers surrounding the plug of filtration material; wherein the hardness of the filter at the downstream end segment is at least about 90%, and wherein the filtration material extends to the furthest downstream end of the filter, and wherein the one or more filter wrappers have a basis weight between about 50 grams per square meter and about 100 grams per square meter.

Features and advantages described in relation to one aspect of the invention may also be applicable to another aspect of the invention.

The invention will be further described, by way of example only, with reference to the accompanying drawings in which.

As discussed previously, the inventors of the present invention have noted that, in order for a consumer to be able to enjoy chewing the mouth end of the smoking article filter during the smoking experience, the mouth end must have a hardness of at least about 90%.

The hardness of various types of smoking article was tested using a known DD60A Densimeter (manufactured and made commercially available by HEINR. BORGWALDT GmbH, Germany) device, which was fitted with a measuring head for cigarettes and with a cigarette receptacle, as described above. The samples were tested by following the method which is recommended for the known DD60A Densimeter device (manufactured and made commercially available by HEINR. BORGWALDT GmbH, Germany). That is, a sample of smoking articles were held in parallel alignment, and subjected to an overall load of 2 kg, for a period of 20 seconds, and the diameters of the smoking articles before and after compression were recorded. The depression was used to determine the hardness (%) of each smoking article.

Figure 1:
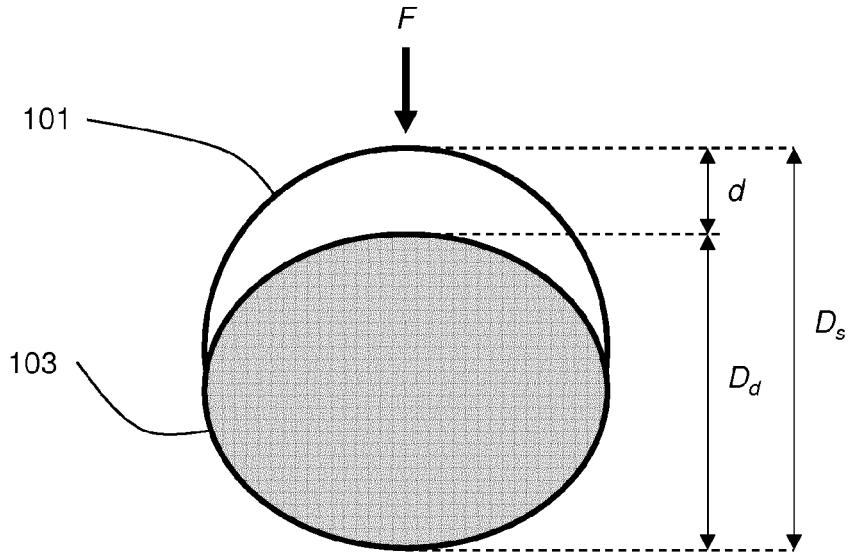
FIG. 1 illustrates the definition of hardness.
Figure 2:
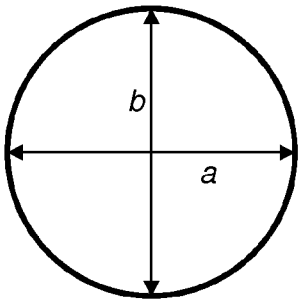
FIG. 2 illustrates the definition of ovality, using a perfect circle.
Figure 3:
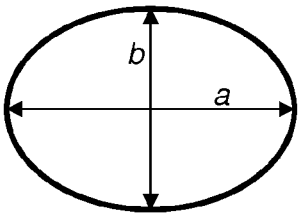
FIG. 3 illustrates the definition of ovality, using an oval.
Figure 4:
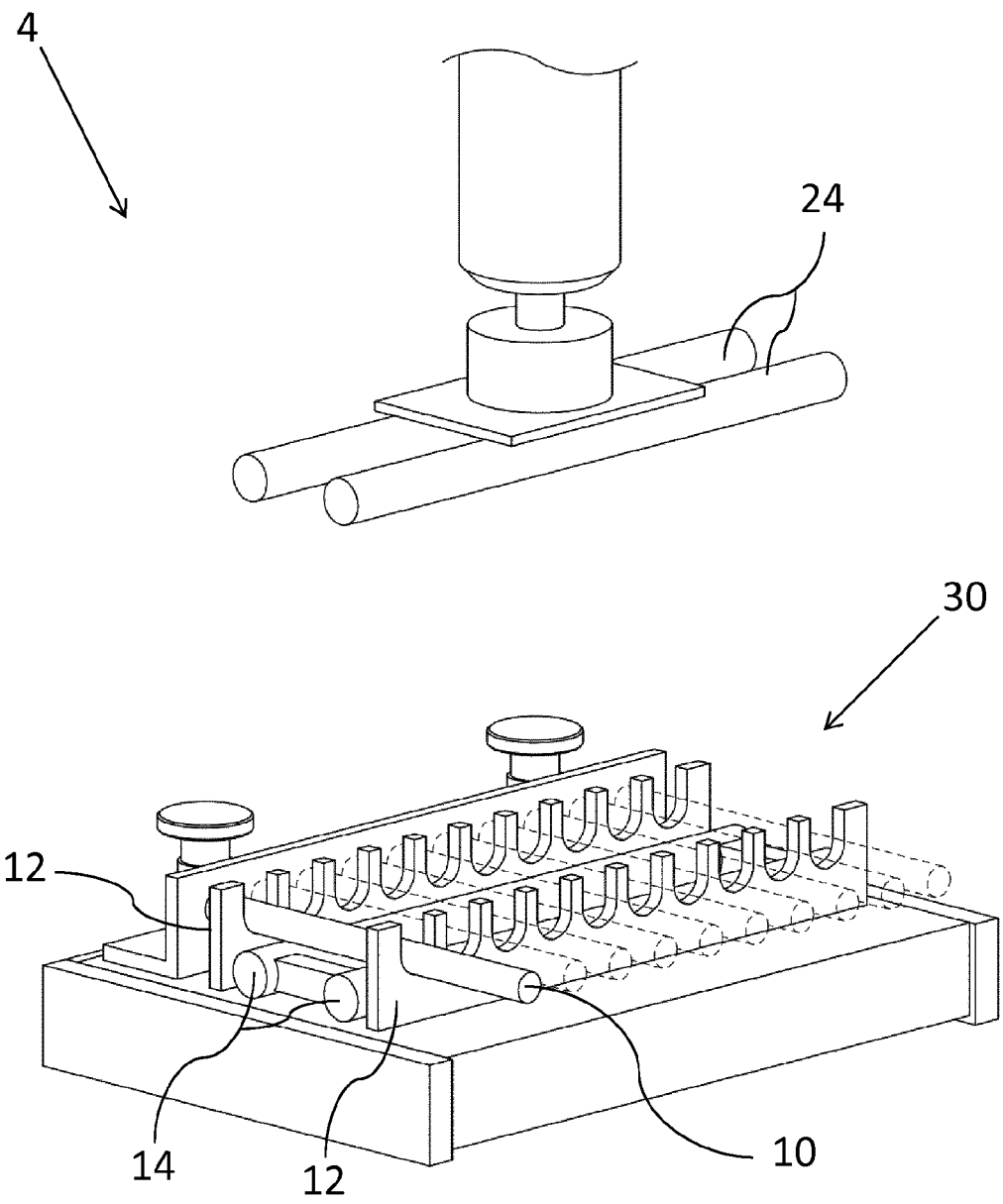
FIG. 4 illustrates a perspective view of an apparatus for determining the hardness of a filter or a smoking article, in a first configuration.
Figure 5:
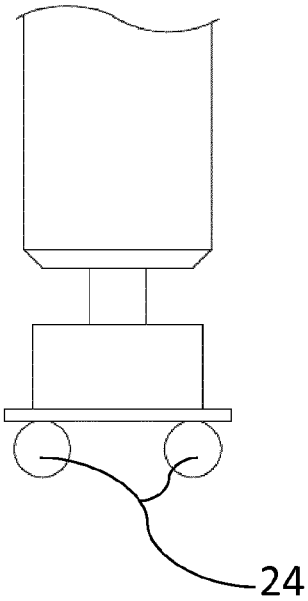
FIG. 5 illustrates a side view of the apparatus of FIG. 4, in a first configuration.
Figure 5:
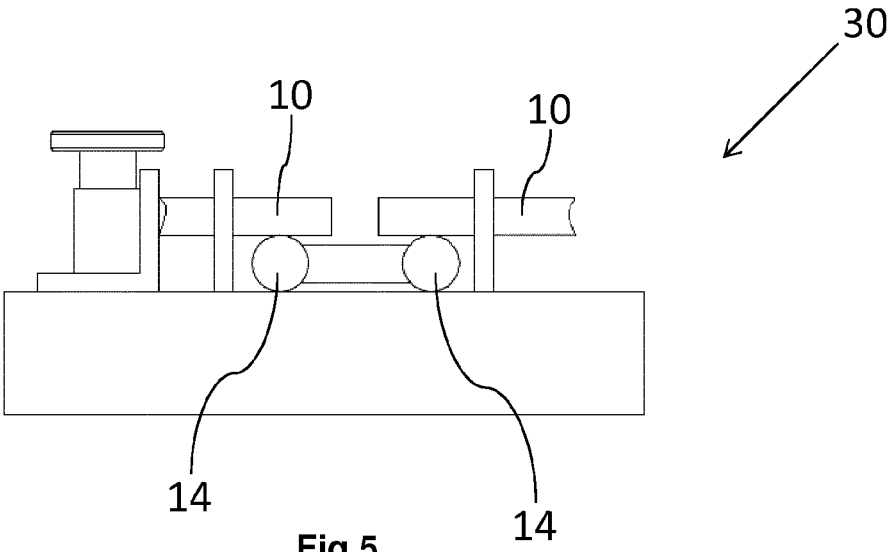
Figure 6:
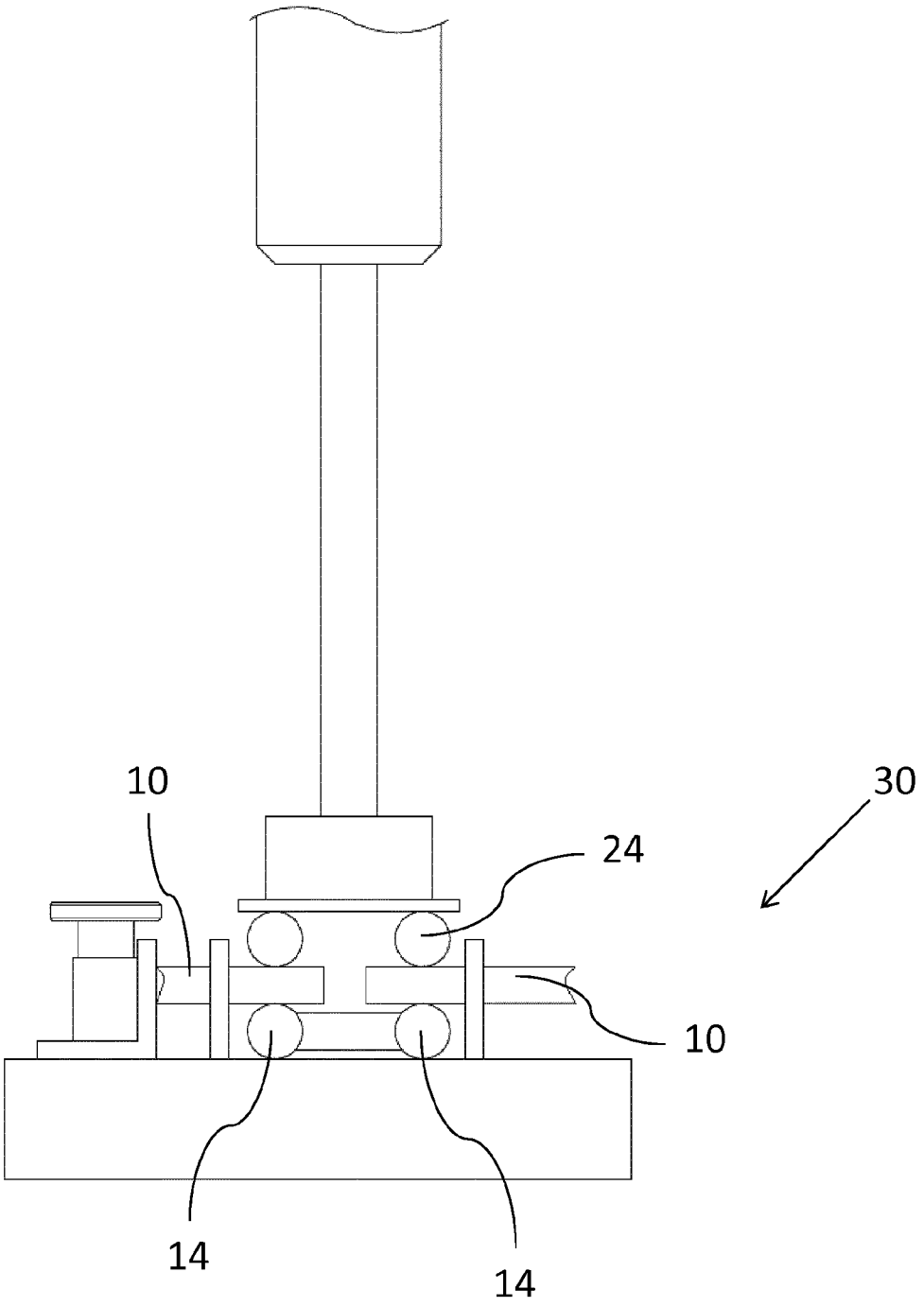
FIG. 6 illustrates a side view of the apparatus of FIG. 4, in a second configuration.
Figure 7:
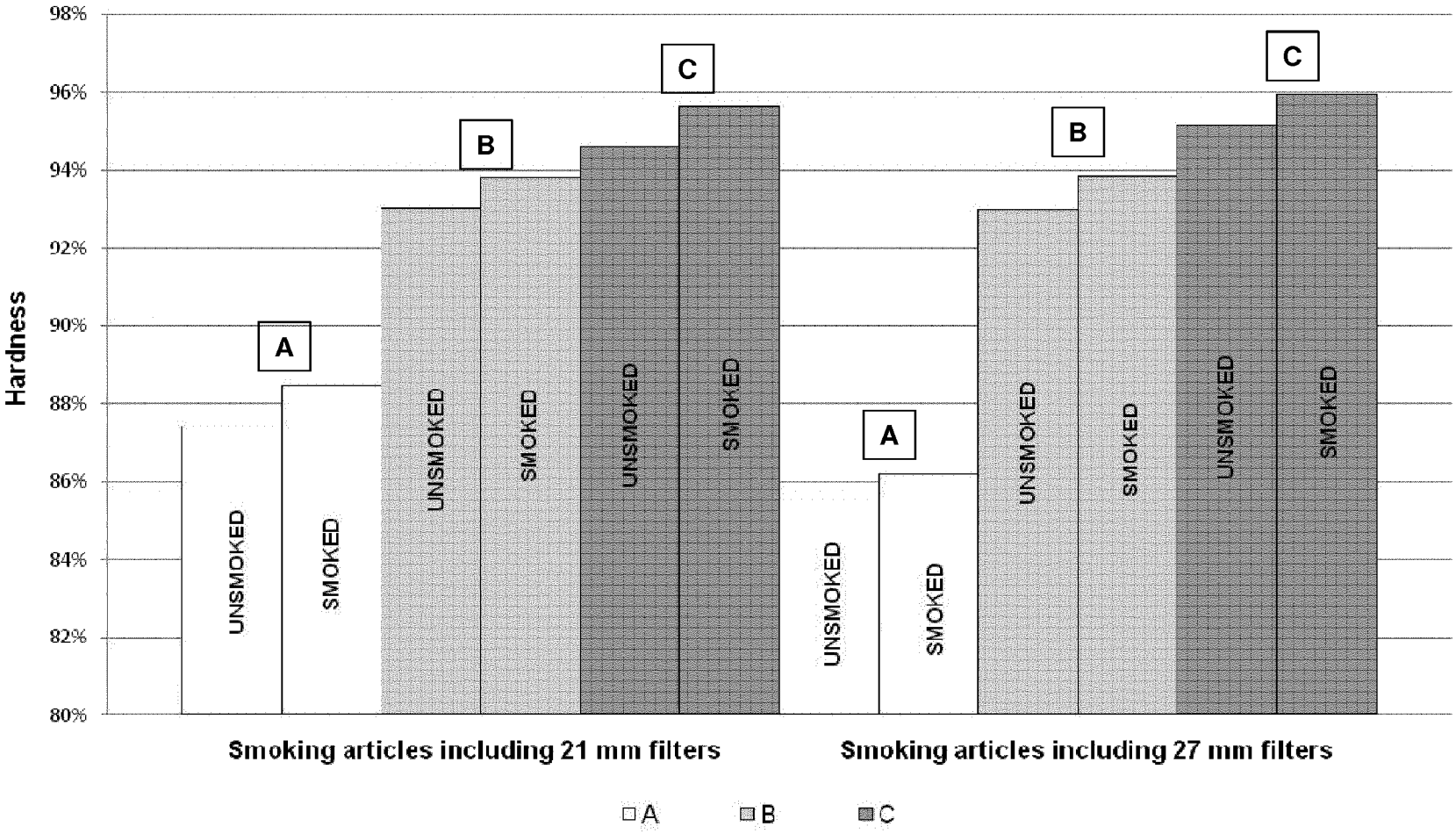
FIG. 7 is a graph showing hardness (%) for six types of filter (within a smoking article), both smoked and unsmoked.
Figure 8:
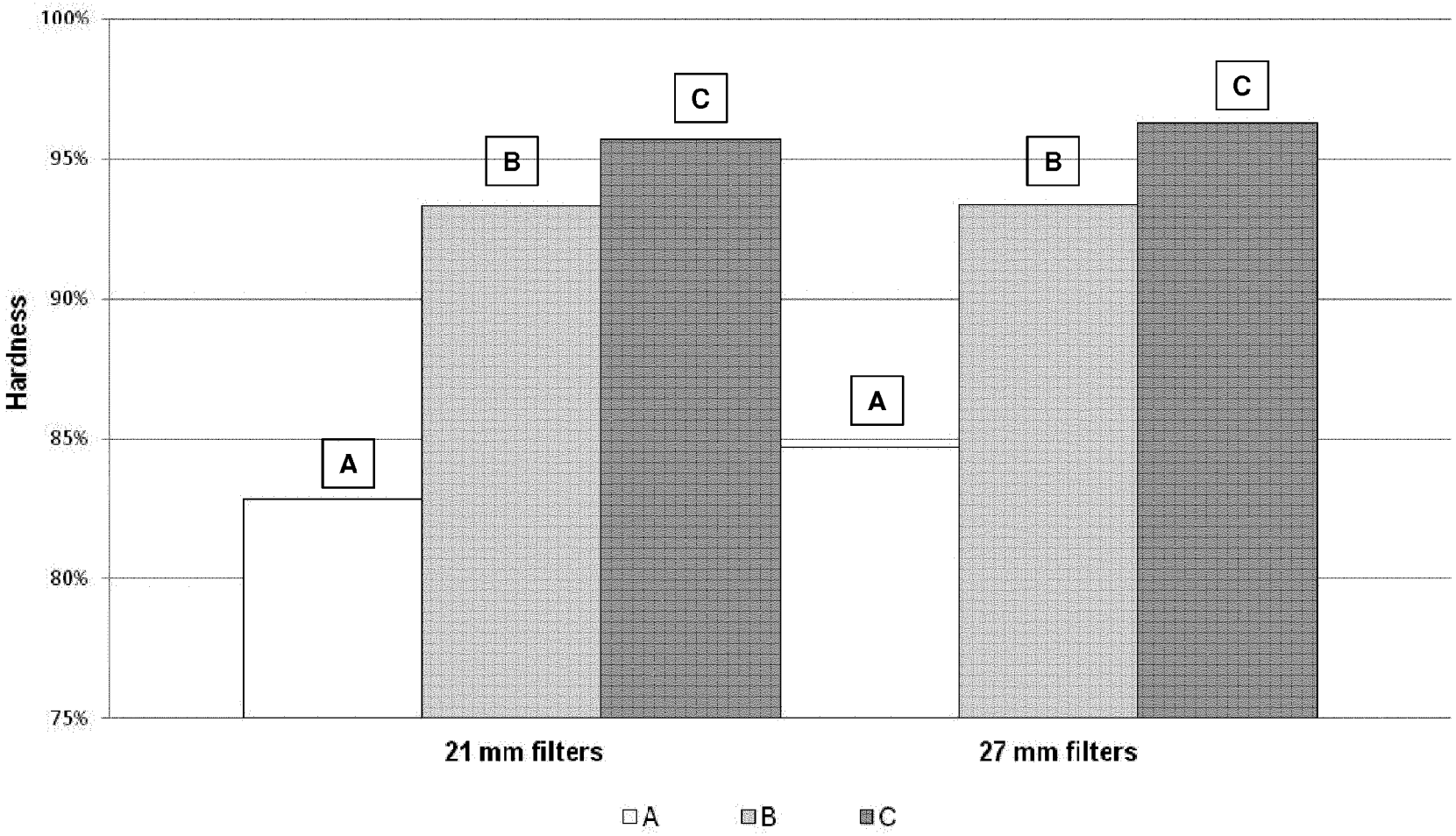
FIG. 8 is a graph showing hardness (%) for six types of filter (not within a smoking article).

The apparatus for testing the hardness of the smoking articles filters is shown in FIGS. 4, 5 and 6, and the measured hardness values are shown in FIGS. 7 and 8.

FIG. 4 is a perspective view of an apparatus 4, such as a DD60A Densimeter device, for determining the hardness of a filter of a smoking article. The apparatus includes two parallel load applying rods 24 positioned over a support plate 30. The support plate 30 includes two parallel, spaced apart walls 12, with each wall 12 having ten equally spaced recesses. The recesses are arranged to prevent the smoking articles 10 from contacting one another during testing.

As can be seen in FIG. 4, ten identically designed smoking articles 10 are aligned parallel in a plane, and placed on underlying cylindrical rods 14. The smoking articles 10 extend between corresponding recesses in the walls 12 to hold the smoking articles in place. The underlying cylindrical rods 14 extend parallel to the walls 12. Each smoking article 10 contacts the underlying rods 14 at two points, making for twenty total points of contact between the smoking articles to be tested and the underlying rods 14.

To test the hardness of a smoking article's filter, the smoking articles should be positioned such that the portion of the filter to be tested is in contact with the underlying rods 14. If filter is too short and the portion of the filter to be tested either does not contact both rods or contacts the rods very close to the ends of the portion of the filter to be tested, then it would appreciated that this could be achieved by using twenty cigarettes in a back-to-back configuration, such as that shown in FIG. 5.

As shown, the concept of the DD60A Test is that the underlying cylindrical rods contact the sample material to be tested at twenty contact points. If the filter is sufficiently long to extend across the underlying rods, then the twenty contact points can be provided with ten samples (as shown in FIG. 4). If the filter is not sufficiently long, then the twenty contact points can be provided with twenty samples, as shown in FIG. 5.

As can be seen in FIG. 5, portions of the tobacco rods have been removed from each smoking article 10, and the filter portion of each smoking article 10 rests on a respective cylindrical rod 14. In the present case, the hardness of the mouth end segment is being tested, and therefore it is this portion of the filter which rests on the rod 14, and the mouth end segment is approximately centered on the rods 14. If necessary, the tips of the smoking articles extending away from the cylindrical rods 14 may be supported by an underlying supporting means to prevent pivoting of the smoking articles.

The apparatus is shown in FIG. 5 in a first configuration, in which the two load applying cylindrical rods 24 are raised above and out of contact from the smoking articles 10. To test the hardness of the smoking articles, the load applying cylindrical rods 24 are lowered to a second configuration, to come into contact with the smoking articles 10, as shown in FIG. 6. When in contact with the smoking articles 10, the load applying rods 24 impart an overall load of 2 kg across the twenty contact points of the smoking articles 10 for a duration of 20 seconds. After 20 seconds have elapsed (and with the load still being applied to the smoking articles), the depression in the load applying cylindrical rods 24 across the smoking articles is determined, and then used to calculate the hardness.

FIG. 7 is a graph showing hardness (%) for six types of smoking article filter, both smoked and unsmoked. In FIG. 7, each filter was incorporated into a smoking article and subjected to the DD60A Test described above, and illustrated by FIGS. 4 to 6.

The six types of smoking article filters tested (using the above described method and apparatus) were:

Filter Type A: Cigarette filters having a basis weight of the filter wrapper of about 26 $gm^{-2}$ and a filter length of 21 mm, and cigarette filters having a basis weight of the filter wrapper of about 26 $gm^{-2}$ and a filter length of 27 mm. In both cases, the smoking article diameter is 7.84 mm, the filter wrapper thickness is 40 μm and the tipping material thickness is 40 μm. Both these sets of data are shown with white bars in FIG. 7, 21 mm filters on the left hand side of FIG. 7, 27 mm filters on the right hand side of FIG. 7.

Filter Type B: Filters according to the invention, having a basis weight of the filter wrapper of about 78 $gm^{-2}$ and a filter length of 21 mm, and filters according to the invention, having a basis weight of the filter wrapper of about 78 $gm^{-2}$ and a filter length of 27 mm. In both cases, the smoking article diameter is 7.84 mm, the filter wrapper thickness is 100 μm and the tipping material thickness is 40 μm. Both these sets of data are shown with light grey bars in FIG. 7, 21 mm filters on the left hand side of FIG. 7, 27 mm filters on the right hand side of FIG. 7.

Filter Type C: Cigarette filters having a basis weight of the filter wrapper of about 110 $gm^{-2}$ and a filter length of 21 mm, and cigarette filters having a basis weight of the filter wrapper of about 110 $gm^{-2}$ and a filter length of 27 mm. In both cases, the smoking article diameter is 7.84 mm, the filter wrapper thickness is 140 μm and the tipping material thickness is 40 μm. Both these sets of data are shown with dark grey bars in FIG. 7, 21 mm filters on the left hand side of FIG. 7, 27 mm filters on the right hand side of FIG. 7.

As can be seen from FIG. 7, there is little difference in hardness between the 21 mm filters and the 27 mm filters. In addition, as can be seen from FIG. 7, there is little difference in hardness between the smoked and unsmoked filters.

However, as can be seen from FIG. 7, the hardness of the smoking article filters tends to increase as the basis weight of the filter wrapper increases. The mean increase in hardness between the 26 $gm^{-2}$ basis weight filters and the 78 $gm^{-2}$ basis weight filters was found to be 6.50%, which represents an increase of 0.125% per $gm^{-2}$ increase in basis weight. However, the mean increase in hardness between the 78 $gm^{-2}$ basis weight filters and the 110 $gm^{-2}$ basis weight filters was found to be 1.91%, which represents an increase of only 0.060% per $gm^{-2}$ increase in basis weight.

Thus, the relationship between basis weight and hardness is not linear, and hardness tends to increase relatively more at lower basis weight levels. Thus, the inventors have appreciated that the use of a filter wrapper having a basis weight of about 78 $gm^{-2}$ sufficiently increases the hardness, while avoiding the need for a very stiff filter wrapper, which may make manufacture more difficult.

The hardness of various types of filter rods (when not incorporated into a smoking article) was also tested using a DD60A Densimeter (manufactured and made commercially available by HEINR. BORGWALDT GmbH, Germany) fitted with a measuring head for cigarettes and with a cigarette receptacle, as described above, and following the DD60A Test method described above.

FIG. 8 is a graph showing hardness (%) for six types of smoking article filter. In FIG. 8, each filter was not incorporated into a smoking article. The six types of smoking article filters tested (using the above described apparatus and methodology) were the same as in FIG. 7, that is:

Filter Type A: Filters having a basis weight of the filter wrapper of about 26 $gm^{-2}$ and a filter length of 21 mm/27 mm. In both cases, the filter wrapper thickness is 40 μm. Both these sets of data are shown with white bars in FIG. 8, 21 mm filters on the left hand side, 27 mm filters on the right hand side.

Filter Type B: Filters according to the invention, having a basis weight of the filter wrapper of about 78 $gm^{-2}$ and a filter length of 21 mm/27 mm. In both cases, the filter wrapper thickness is 100 μm. Both these sets of data are shown with light grey bars in FIG. 8, 21 mm filters on the left hand side, 27 mm filters on the right hand side.

Filter Type C: Filters having a basis weight of the filter wrapper of about 110 $gm^{-2}$ and a filter length of 21 mm/27 mm. In both cases, the filter wrapper thickness is 140 μm. Both these sets of data are shown with dark grey bars in FIG. 8, 21 mm filters on the left hand side, 27 mm filters on the right hand side.

Just as in FIG. 7, in FIG. 8, the hardness of the smoking article filters tends to increase as the basis weight of the filter wrapper increases, but the relationship between basis weight and hardness is not linear. Thus, the inventors have appreciated that the use of a filter wrapper having a basis weight of about 78 $gm^{-2}$ sufficiently increases the hardness, while avoiding the need for a very stiff filter wrapper, which may make manufacture more difficult.

As discussed previously, the inventors of the present invention have noted that, in order for a consumer to be able to enjoy the smoking experience after chewing the mouth end of the smoking article filter, it is preferable for the mouth end to have an ovality, after a 50% deformation of less than about 25%, both before and after smoking.

The ovality of various types of smoking article was tested using the method described above. That is, the smoking articles were subject to deformation and then the mouth ends of the smoking articles were recorded using a transparent stage. The process was repeated and averaged over ten smoking articles.

Figure 9:
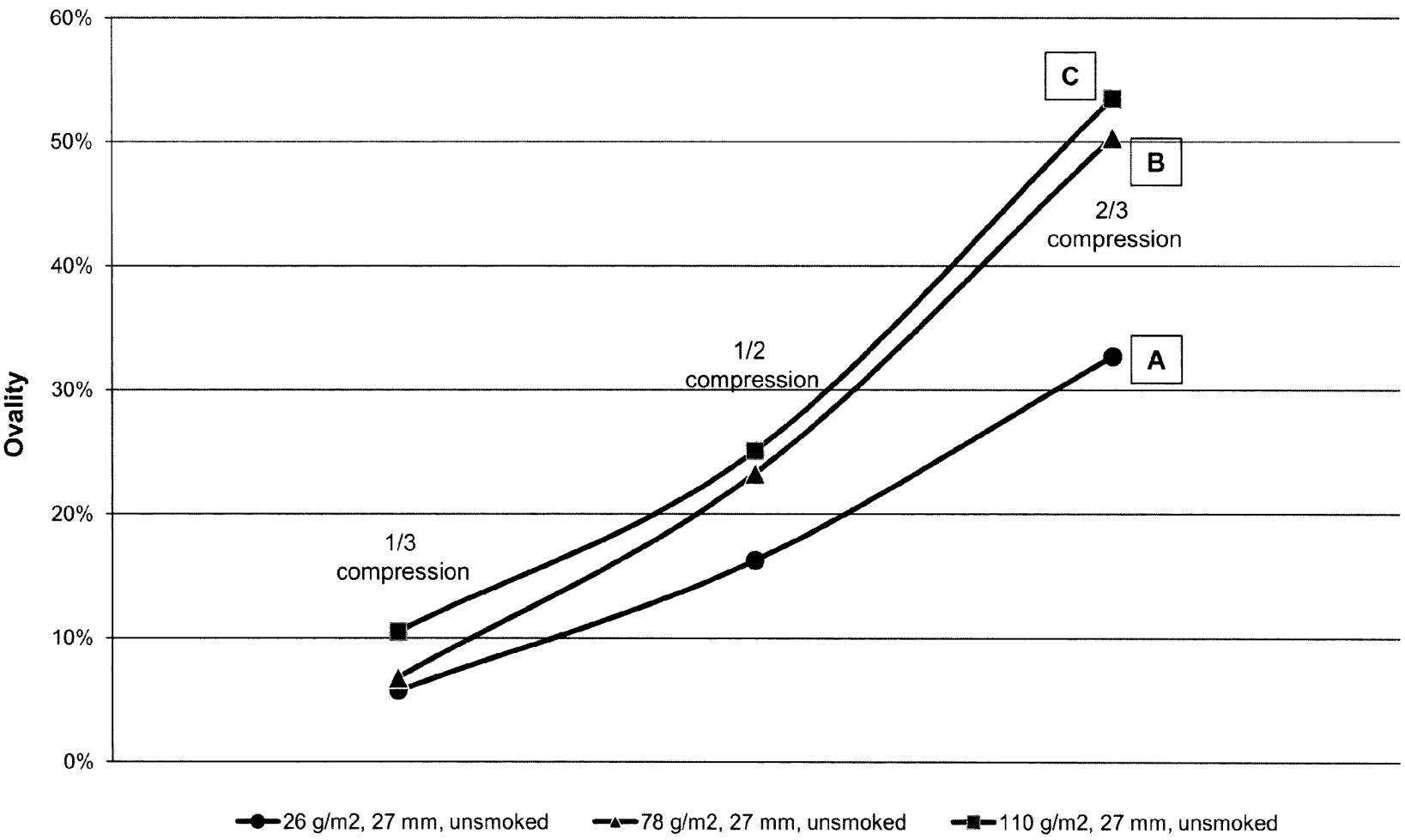
FIG. 9 is a graph showing ovality (%) for three types of unsmoked filters.
Figure 10:
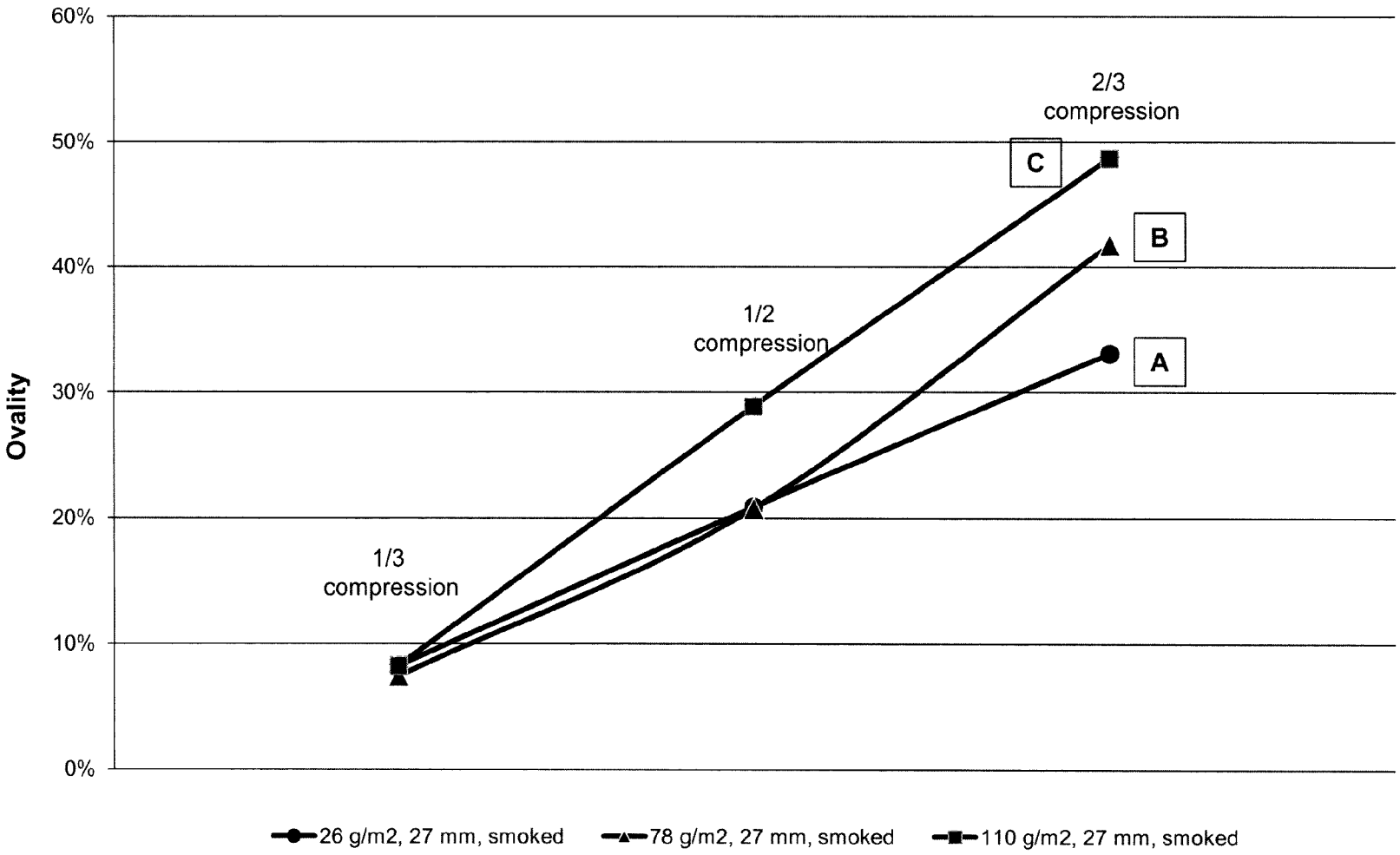
FIG. 10 is a graph showing ovality (%) for three types of smoked filters.

FIGS. 9 and 10 are graphs showing ovality (%) for three types of smoking article filter, both smoked and unsmoked.

Referring to FIGS. 9 and 10, "⅓ compression" denotes that the smoking article mouth end was deformed to 66.67% of its original diameter (i.e. compressed by one third) and then released, "½ compression" denotes that the smoking article mouth end was deformed to 50% of its original diameter (i.e. compressed by one half) and then released, and "⅔ compression" denotes that the smoking article mouth end was deformed to 33.33% of its original diameter (i.e. compressed by two thirds) and then released.

The three types of smoking article filters tested (using the above described apparatus) were:

Filter Type A: Cigarette filters having a basis weight of the filter wrapper of about 26 $gm^{-2}$, a filter length of 27 mm, a smoking article diameter of 7.84 mm, a filter wrapper thickness of 40 μm and a tipping material thickness of 40 μm. Both these sets of data are shown with a black line, unsmoked filters in FIG. 9, smoked filters in FIG. 10.

Filter Type B: Filters according to the invention, having a basis weight of the filter wrapper of about 78 $gm^{-2}$, a filter length of 27 mm, a smoking article diameter of 7.84 mm, a filter wrapper thickness of 100 μm and a tipping material thickness of 40 μm. Both these sets of data are shown with a dark grey line, unsmoked filters in FIG. 9, smoked filters in FIG. 10.

Filter Type C: Cigarette filters having a basis weight of the filter wrapper of about 110 $gm^{-2}$, a filter length of 27 mm, a smoking article diameter of 7.84 mm, a filter wrapper thickness of 140 μm and a tipping material thickness of 40 μm. Both these sets of data are shown with a light grey line, unsmoked filters in FIG. 9, smoked filters in FIG. 10.

As can be seen from FIGS. 9 and 10, the ovality of the smoking article filters after compression tends to increase as the basis weight of the filter wrapper increases. Just as with the hardness, however, the relationship does not appear to be linear.

It would be preferable for the mouth end to return to a perfect circle (0% ovality) after deformation. The closest to this is Filter Type A cigarette filters (where the basis weight of the filter wrapper is about 26 $gm^{-2}$), which have the lowest ovality values overall in FIGS. 9 and 10. However, it can be seen from FIGS. 7 and 8 that such a filter wrapper does not have a high hardness value, and therefore does not provide enough resistance to deformation for the chewing experience to be enjoyable for a consumer. The inventors have appreciated that use of a filter wrapper having a basis weight of about 78 $gm^{-2}$ sufficiently increases the hardness, while limiting the increase in ovality after chewing.

Thus, the smoking articles and filters according to this embodiment of the invention provide for increased hardness in order for the chewing experience to be enjoyable, but decreased ovality after chewing in order for the smoking experience to be enjoyable, even after chewing. This provides an excellent balance between enjoyable chewing and smoking experiences.

The invention claimed is:

1. A smoking article comprising:

a tobacco rod;

a filter comprising a plug of filtration material that defines a downstream end segment of the smoking article, the plug being surrounded by one or more filter wrappers; and tipping material attaching the tobacco rod and the filter;

wherein a hardness of the smoking article at the downstream end segment is at least about 90% and no more than about 94%, wherein the filtration material extends to a furthest downstream end of the filter, the filtration material extending along a whole length of the filter; and wherein the one or more filter wrappers have a basis weight between 70 grams per square metre and 80 grams per square metre, and a porosity of about 100 Coresta units or less.

2. A smoking article according to claim 1, wherein the hardness of the smoking article at the downstream end segment is at least about 92%.

3. A smoking article according to claim 1, wherein the ovality of the furthest downstream end of the smoking article, after a 50% deformation of the furthest downstream end of the smoking article, performed after the smoking article has been subjected to a smoking test, is less than about 25%.

4. A smoking article according to claim 1, wherein the one or more filter wrappers have a bending stiffness of at least about 0.08 N in a machine direction of the filter wrapper.

5. A smoking article according to claim 1, wherein the filtration material comprises cellulose acetate.

6. A smoking article according to claim 1, wherein the filtration material has a denier per filament of between about 5.0 dpf and about 12.0 dpf.

7. A smoking article according to claim 1, wherein the filter provides a resistance to draw of between about 130 mm $H_2O$ and about 210 mm $H_2O$.

8. A smoking article according to claim 1, wherein the filter includes an adhesive or plasticizer.

9. A smoking article according to claim 1, wherein the tipping material includes a ventilation zone at a location about the filter.

* * * * *